United States Patent [19]

Hitchings

[11] Patent Number: 4,955,427

[45] Date of Patent: Sep. 11, 1990

[54] PLACEMENT OF PARTICULATES ONTO REFRACTORY FILTERS FOR LIQUID METALS

[75] Inventor: Jay R. Hitchings, Downingtown, Pa.

[73] Assignee: Amenex Associates, Inc., West Chester, Pa.

[21] Appl. No.: 351,662

[22] Filed: May 15, 1989

[51] Int. Cl.[5] ..... B22C 9/08

[52] U.S. Cl. ..... 164/358; 164/349; 164/134; 210/490; 210/507

[58] Field of Search ..... 164/55.1, 56.1, 57.1, 164/58.1, 59.1, 134, 358, 349; 210/490, 507, 509

[56] References Cited

U.S. PATENT DOCUMENTS 4,798,615 1/1989 Fukuta et al. ..... 164/358

FOREIGN PATENT DOCUMENTS 56-38291 9/1981 Japan ..... 164/358
62-244549 10/1987 Japan ..... 164/134
923738 4/1982 U.S.S.R. ..... 164/358

*Primary Examiner*—Richard K. Seidel
*Attorney, Agent, or Firm*—Charles S. Knothe

[57] ABSTRACT

A filter for molten metal with a particulate coating for simultaneously metallurgically treating and filtering is disclosed. A layer of particulates such as ferroalloy, deoxidizer, grain refiner, inoculant or master alloy is placed on the surface of a hard-fired ceramic or refractory cloth filter for treating liquid metal. The particles are held in place by a coating of carbonaceous resin which is applied to the surface of the filter and which also protects the filter and particles against abrasion and moisture. The placement of the particulate additives on the filter allows the molten metal to be metallurgically treated and filtered simultaneously.

2 Claims, No Drawings

PLACEMENT OF PARTICULATES ONTO REFRACTORY FILTERS FOR LIQUID METALS

BACKGROUND OF THE INVENTION

Hard-fired ceramic filters are the most common type of filter in general use in foundries today. Refractory cloth filters have been used sparingly in European foundries and have been tested in some domestic foundries. Although these cloth filters provided excellent filtration characteristics and were successful in trials, they were never promoted or developed for ferrous casting in the U.S. because of high cost and difficult availability. A refractory cloth filter of novel composition is the subject of a separate patent application by the applicant.

The conventional application of hard-fired ceramic and refractory cloth filters has been to place them at the top of the downgate of the mold, immediately underneath the pouring basin or at the base of the downgate on the mold parting line. The latest developments incorporate the filters into the runner bar; the refractory cloth filters can be placed at the ingates to the casting cavity where they can also act as knock-off cores.

In the production of most ferrous alloys and some nonferrous castings the molten metal is treated with various types of ferroalloys, inoculants, master alloys, grain refiners and deoxidants. Usually the beneficial effects of these alloy additions are short-lived; therefore, it is best to make such additions as late in the casting cycle as possible.

The general practice has been either to dribble the additive into the stream of metal entering the mold or to drop it into the downsprue before pouring the metal on top of it. Both of these methods waste alloy, do not supply an accurate weight of additive and involve high maintenance costs for the additive placement equipment. There are now no hard-fired ceramic or refractory cloth filters available for molten metal treatment with metal additives on their surfaces.

SUMMARY OF THE INVENTION

A filter to metallurgically filter and treat molten metal with particulate additives such as ferroalloys, inoculants, grain refiners, deoxidizers and master alloys is made from a hard fired ceramic or refractory cloth filter, with particulate additives placed on the surface of the filter and encapsulated in a carbonaceous resin coating.

DESCRIPTION OF THE PREFERRED EMBODIMENTS

In this invention the hard-fired ceramic or the refractory cloth filter is sprayed with or dipped into a carbonaceous resin such as phenol formaldehyde to coat its surfaces. The particulate additives are then placed on the resin-coated surfaces in the desired amount and in the selected area of the filter. The resin is then dried or cured to harden the resin into a protective, tenacious coating that covers the filter and encapsulates the particles. It is important that the distribution of the particulate additives be controlled so as not to block the openings in the filter through which the liquid metal is to pass.

It is also important that each particle be coated with the resin. If a large amount of particulate additive is necessary per unit area of filter, successive layers of resin-bonded particles may be added or resin bonded briquettes made from particulate may be placed on the filter surface. It is essential that the particulates not be prevented from dissolving in the liquid metal. Different additives can be placed in various parts of the filter (in layers, along the sides of the openings, or on the upstream vs. the downstream faces), depending on the functions of the additives.

The resin is then dried or cured to harden it and to reduce the amount of gaseous decomposition products which will be given off during the use of the filter. The coating should not be pyrolized at this stage, because that would reduce the protection which the coating affords the filter against abrasion and absorption of water.

The filter is placed in the mold so that all of the liquid metal must first pass through the filter before entering the shaped cavity which is to become the casting. When the first liquid metal reaches the upstream face of the filter, the heat from the liquid metal pyrolizes the resinous coating, driving off the gaseous components, which then pass into the surrounding sand or through the mold vents. The particulate additives will be gradually dissolved as the char partially surrounding them is dissolved or oxidized away by reactions with the oxide particles trapped by the filter. This retardation of the dissolution of the particulate additives proportions their effects among the entire batch of liquid metal entering the mold, minimizing the degree of mixing required to distribute the additives uniformly within the casting. The advantages of this can easily be recognized. The particles held in place by the coating improve the metallurgy of the casting by minimizing the fading of the beneficial effects of the additive during the time between reaction and solidification of the casting. Further, the coating protects the particulate additives and the filter by preventing abrasion and absorption of water during manufacture, storage, shipping and handling. Also, the coating controls the rate of reaction of the particulate additives with the molten metal, distributing the benefits throughout the mass of metal entering the mold cavity. The resin is the subject of a separate patent application by the applicant.

This invention allows the placement of the particulate additives and filters in the parts of the mold where they can be of greatest benefit to the properties of the casting and places a precise amount of additive where it can best be utilized in treating the molten metal. Additionally it permits selected areas of the casting to be treated differently, based on the location of the filter and the specific type of additive placed on that filter. The bulky, non-metallic reaction products are separated from the particulate additives on the upstream side of the filter where they do not adversely affect the properties of the casting. Finally this invention minimizes the number of steps in the casting operation.

EXAMPLES

1-*a*. A 3.5 by 3.5 by 0.5 inch thick hard-fired ceramic filter was coated with a phenol formaldehyde resin, and then four grams of a through-65-mesh alloy of 75 percent ferrosilicon was placed on a three inch diameter area of the center of the upstream side of the filter. The filter was then heated to 300° C. for five minutes to cure and harden the resin coating. After cooling the filter was examined under the microscope; it was determined that the particles of the ferroalloy were completely encapsulated by the resin and that the resin formed a continuous coating on the surface of the filter.

1-*b*. A 3.5 by 3.5 by 5 inch thick hard fired ceramic filter that was coated with resin and had four grams of 75% ferrosilicon alloy applied to its upstream side, as per example 1-*a*, was placed into the runner system of a green sand mold. The alloy on the filter face was facing the incoming molten metal, and all of the molten metal entering the mold had to pass through the filter. Approximately 157 pounds of gray cast iron was poured through the filter in 16 seconds at a temperature of 2453° F. Examination of the filters upstream surface revealed that all of the alloy had dissolved into the molten metal.

2-*a*. A four by four inch square piece of woven refractory cloth filter material was coated with a phenol formaldehyde resin, and then three grams of a through-32-mesh ferrosilicon-based inoculant was placed on a three by three inch square area in the center of the upstream side of the filter. The filter was then heated to 300° C. for 3.5 minutes, cooled and examined. All of the inoculant particles were encapsulated by the resin, and the cured resin had caused the cloth to become hard and rigid. The resin is the subject of a separate patent application by the applicant.

2-*b*. A four by four inch square refractory cloth filter, prepared as per example 2-*a*, was placed into a green sand mold. The filter was placed at the bottom of the down sprue at the parting line between the cope and drag of the mold. The alloy containing face of the filter was facing up towards the incoming molten metal, then 325 pounds of gray cast iron at a temperature of 2497° F. was poured into the mold in thirty-one seconds. A subsequent examination of the filter, after the metal had solidified, revealed that all of the alloy had been dissolved by the molten metal passing through the filter.

I claim:

1. In a casting mold, a filter for metallurgically filtering and treating molten metal with particulate additives comprising:

1. a hard fired ceramic or refractory cloth filter, with particulate additives placed on the surface of the filter and encapsulated in a char forming carbonaceous resin coating.

2. The casting mold of claim 1 wherein said particulate additives are selected from the group comprising ferroalloys, inoculants, grain refiners, deoxidizers, and master alloys.

* * * * *